US007946884B2

(12) United States Patent
Chiang et al.

(10) Patent No.: US 7,946,884 B2
(45) Date of Patent: May 24, 2011

(54) CONVERTER

(75) Inventors: Yung-Hsu Chiang, Taichung Hsien (TW); Hiroshi Ozaki, Nagoya (JP)

(73) Assignees: Buffalo, Inc., Nagoya (JP); Unifive Technology Co., Ltd., Fongyuan (TW)

( * ) Notice: Subject to any disclaimer, the term of this patent is extended or adjusted under 35 U.S.C. 154(b) by 2 days.

(21) Appl. No.: 12/627,522

(22) Filed: Nov. 30, 2009

(65) Prior Publication Data

US 2010/0173514 A1 Jul. 8, 2010

(30) Foreign Application Priority Data

Jan. 6, 2009 (TW) ..... 98200086

(51) Int. Cl.
*H01R 29/00* (2006.01)

(52) U.S. Cl. ..... 439/518; 439/173

(58) Field of Classification Search ..... 439/170–175, 439/518

See application file for complete search history.

(56) References Cited

U.S. PATENT DOCUMENTS 4,973,827 A * 11/1990 Nozaki ..... 219/521
5,848,907 A * 12/1998 Chen ..... 439/172
5,934,921 A * 8/1999 Doong ..... 439/172
6,039,608 A * 3/2000 Amero et al. ..... 439/651
6,109,977 A * 8/2000 Baxter et al. ..... 439/693
6,328,581 B1 * 12/2001 Lee et al. ..... 439/106
6,592,386 B2 * 7/2003 Teng et al. ..... 439/172
6,669,495 B2 * 12/2003 Philips et al. ..... 439/170
6,845,023 B2 * 1/2005 Philips et al. ..... 363/132
6,923,667 B1 * 8/2005 Chen ..... 439/172
6,942,508 B2 * 9/2005 Wong ..... 439/171
7,008,246 B2 * 3/2006 Zhuge ..... 439/173
7,118,399 B1 * 10/2006 Wen et al. ..... 439/166
7,168,968 B1 * 1/2007 Li ..... 439/172
7,168,969 B1 * 1/2007 Wang ..... 439/173
7,179,105 B1 * 2/2007 Hung ..... 439/172
7,232,322 B1 * 6/2007 Yen et al. ..... 439/222
7,264,492 B2 * 9/2007 Liang ..... 439/171
7,273,384 B1 * 9/2007 So ..... 439/172
7,300,297 B1 * 11/2007 Wang et al. ..... 439/173
7,381,059 B2 * 6/2008 Wong ..... 439/22
7,597,570 B2 * 10/2009 So ..... 439/172
7,601,023 B1 * 10/2009 Ma et al. ..... 439/518
7,632,119 B1 * 12/2009 Ma et al. ..... 439/172

(Continued)

OTHER PUBLICATIONS

12/627,759 Nov. 30, 2009 Chiang, et al.

*Primary Examiner* — Ross N Gushi
(74) *Attorney, Agent, or Firm* — Oblon, Spivak, McClelland, Maier & Neustadt, L.L.P.

(57) ABSTRACT

A converter has a casing and a plug. The casing has a mounting recess, an engaging tab and multiple mounting protrusions. The mounting recess is formed in the casing. The engaging tab is formed on and protrudes from the mounting recess. The mounting protrusions are formed on the mounting recess. The plug is detachably mounted on the casing and has an escutcheon, an engaging protrusion, multiple terminals and a pinhole. The escutcheon covers the mounting recess. The engaging protrusion is formed on the escutcheon, is mounted in the mounting recess and has an engaging hole and multiple holding grooves. The engaging hole is formed in the engaging protrusion to engage the engaging tab. The holding grooves are formed on the engaging protrusion and engage the mounting protrusions. The terminals are formed on the escutcheon. The pinhole is formed through the escutcheon and communicates with the engaging hole.

7 Claims, 7 Drawing Sheets

U.S. PATENT DOCUMENTS

| | | | | |
|---|---|---|---|---|
| 7,632,137 | B1 * | 12/2009 | Ma et al. | 439/518 |
| 7,654,838 | B1 * | 2/2010 | Zhuge | 439/173 |
| 7,753,721 | B1 * | 7/2010 | Wu | 439/518 |
| 2003/0211767 | A1 * | 11/2003 | Philips et al. | 439/170 |
| 2004/0132328 | A1 * | 7/2004 | Wu | 439/172 |
| 2005/0136717 | A1 * | 6/2005 | Lai | 439/170 |
| 2005/0176281 | A1 * | 8/2005 | Zhuge | 439/173 |
| 2007/0238341 | A1 * | 10/2007 | So | 439/172 |
| 2010/0120278 | A1 * | 5/2010 | Yang | 439/171 |
| 2010/0173526 | A1 * | 7/2010 | Chiang et al. | 439/620.1 |

* cited by examiner

CONVERTER

BACKGROUND OF THE INVENTION

1. Field of the Invention

The present invention relates to a converter, and more particularly to a converter having an easily and securely changeable plug.

2. Description of Related Art

A conventional converter is used to transform and rectify voltage of a power source and is frequently adopted for charging batteries, portable electrical devices and the like. The conventional converter has a casing and a plug. The casing has an interior, a conversion module and a connection surface. The conversion module is mounted in the interior of the casing. The plug is formed on and protrudes from the connection surface of the casing and selectively mounted in the power source. Although, the conventional converter can provide a transforming effect, if the power outlet has a different arrangement or orientation, a different corresponding plug must be used. Therefore, users require adaptors or different converters, increasing the cost of using the conventional converter. Additionally, manufacturers must produce distinct plugs for each market and may have to redesign molds and tools.

A detachable converter has a casing and a plug. The casing of the detachable converter further has a mounting recess formed in the connection surface of the casing and the plug has a mounting panel detachably mounted in the mounting recess of the casing. The plug can be detachably connected to the casing by the mounting recess and the mounting panel, but the plug may be separated from the casing when pulling the detachable converter out of the power source causing electric shock or a poor connection may be a fire and safety risk.

To overcome the shortcomings, the present invention provides a converter to mitigate or obviate the aforementioned problems.

SUMMARY OF THE INVENTION

The main objective of the present invention is to provide a converter having an easily and securely changeable plug.

The converter in accordance with the present invention has a casing and a plug. The casing has a mounting recess, an engaging tab and multiple mounting protrusions. The mounting recess is formed in the casing. The engaging tab is formed on and protrudes from the mounting recess. The mounting protrusions are formed in the mounting recess. The plug is detachably mounted in the casing and has an escutcheon, an engaging protrusion, multiple terminals and a pinhole. The escutcheon covers on the mounting recess. The engaging protrusion is formed on and protrudes from the escutcheon, is mounted in the mounting recess and has an engaging hole and multiple holding grooves. The engaging hole is formed in the engaging protrusion to engage the engaging tab. The holding grooves are formed on the engaging protrusion and engage the mounting protrusions. The terminals are formed on and protrude from the escutcheon. The pinhole is formed through the escutcheon and communicates with the engaging hole Other objectives, advantages and novel features of the invention will become more apparent from the following detailed description when taken in conjunction with the accompanying drawings.

DETAILED DESCRIPTION OF THE PREFERRED EMBODIMENT

Figure 1:
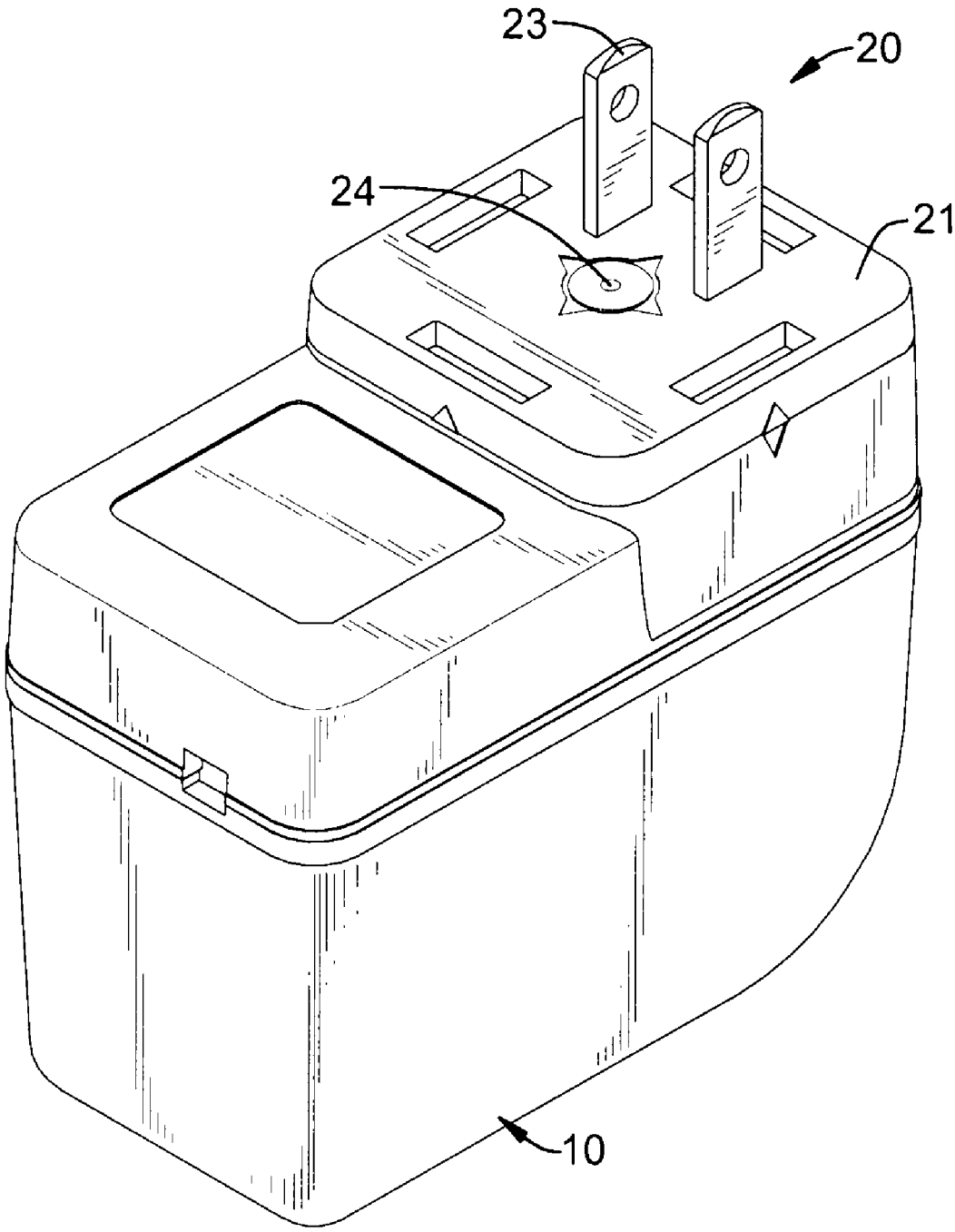
FIG. 1 is a perspective view of a first embodiment of a converter in accordance with the present invention.
Figure 2:
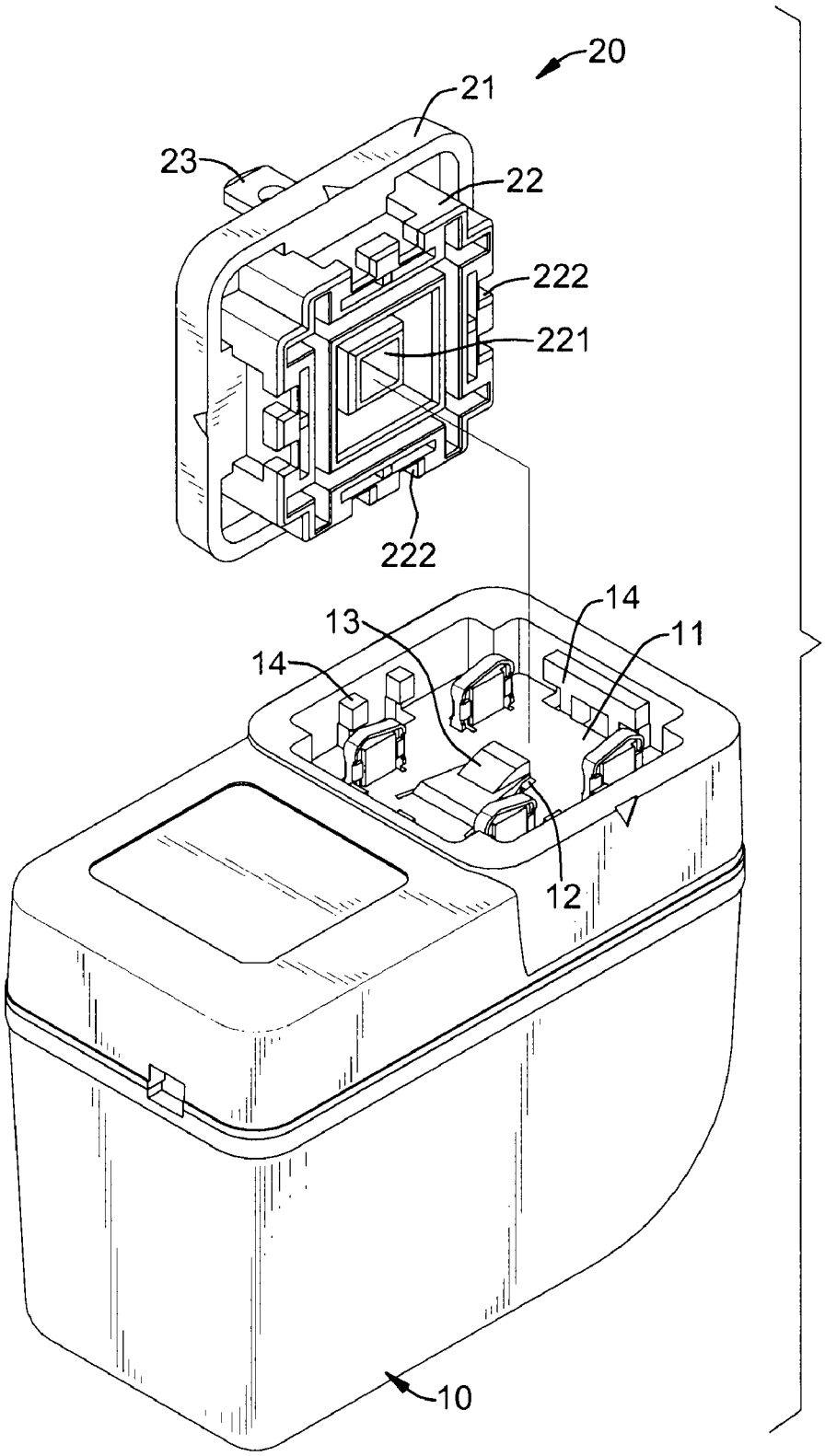
FIG. 2 is an exploded perspective view of the converter in FIG. 1.

With reference to FIGS. 1, 2, 6 and 7, a converter in accordance with the present invention comprises a casing (10) and a plug (20, 20').

The casing (10) may be a parallelepiped and has a connection side, a mounting recess (11), a through hole (12), an engaging tab (13) and multiple mounting protrusions (14).

The mounting recess (11) may be square, is formed in the connection side of the casing (10) and has a bottom, an annular sidewall and a center.

The through hole (12) may be square and is formed through the bottom of the mounting recess (11).

The engaging tab (13) is formed on and protrudes from the bottom of the mounting recess (11) and may be disposed in the through hole (12) near the center of the mounting recess (11).

The mounting protrusions (14) are formed on the annular sidewall of the mounting recess (11).

The plug (20, 20') is detachably mounted on the casing (10) and has an escutcheon (21, 21'), an engaging protrusion (22, 22'), multiple terminals (23, 23') and a pinhole (24, 24').

The escutcheon (21, 21') covers the mounting recess (11) of the casing (10) and has an outer side and a connection side.

The engaging protrusion (22, 22') is formed on and protrudes from the connection side of the escutcheon (21, 21'), corresponds to and is mounted in the mounting recess (11) of the casing (10) and has a center, an outer sidewall, an engaging hole (221, 221') and multiple holding grooves (222, 222'). The engaging hole (221, 221') is formed in the center of the engaging protrusion (22, 22') to engage the engaging tab (13) of the casing (10). The holding grooves (222, 222') are formed on the outer sidewall of the engaging protrusion (22, 22') and engage the mounting protrusions (14) of the casing (10).

The terminals (23, 23') are formed on and protrude from the outer side of the escutcheon (21, 21').

The pinhole (24, 24') is formed through the escutcheon (21, 21') and aligns with the engaging tab (13).

Figure 3:
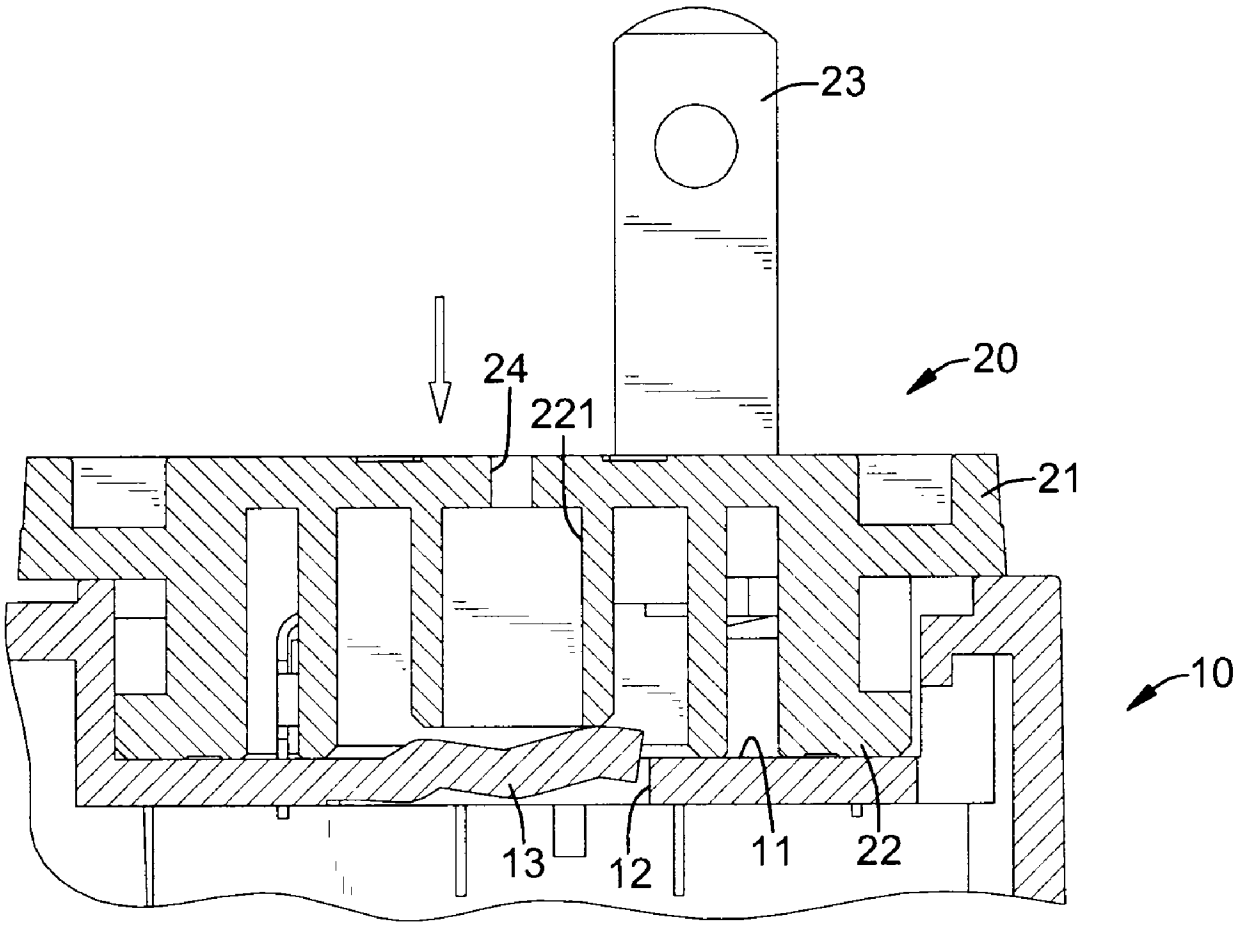
FIGS. 3 and 4 are operational side views in partial cross section of the converter in FIG. 2 showing that a plug being mounted to a casing of the converter.
Figure 4:
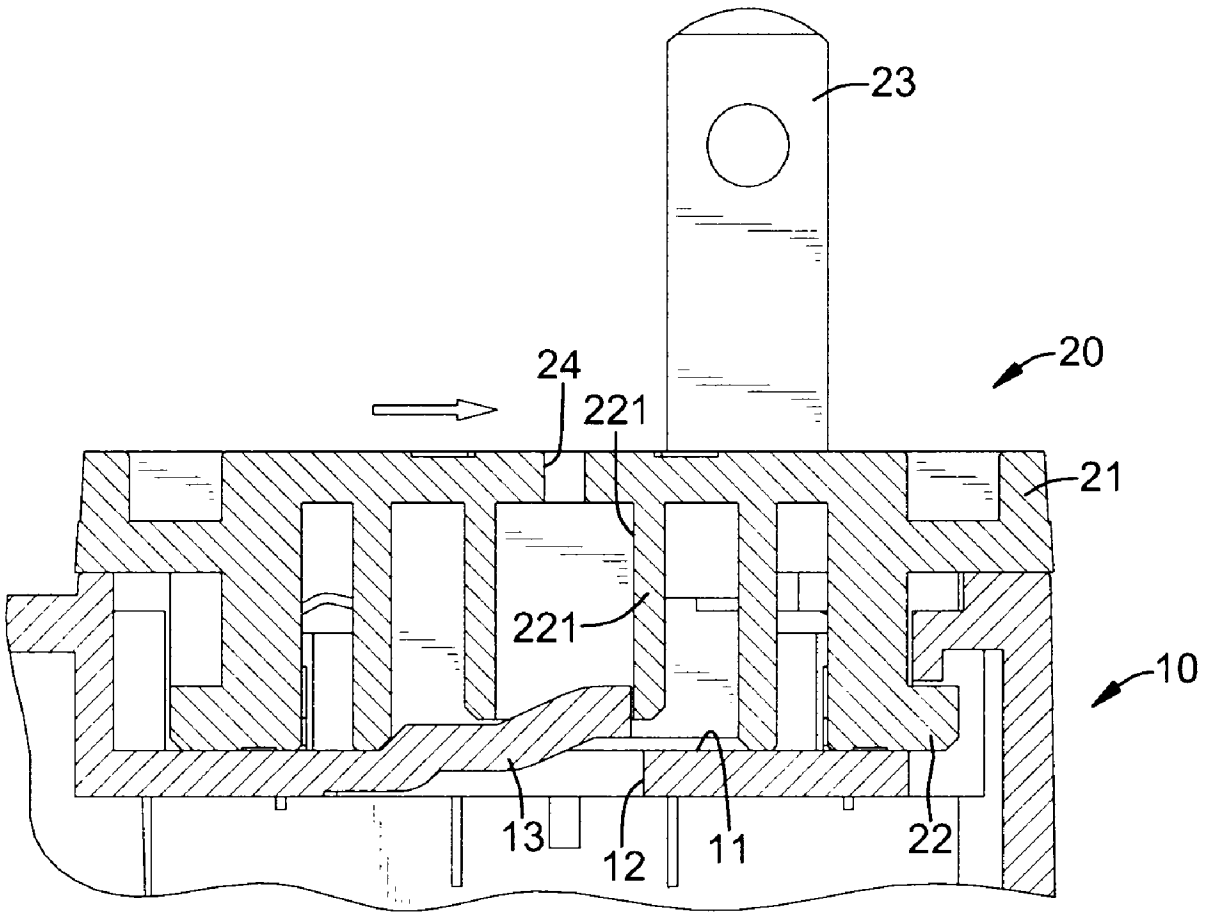

With further reference to FIGS. 3 and 4, the plug (20) is mounted on the casing (10) by inserting the engaging protrusion (22) of the plug (20) into the mounting recess (11) and moving the plug (20) relative to the mounting recess (11) of the casing (10) to make the engaging hole (221) of the engaging protrusion (22) engage the engaging tab (13) of the casing (10). At the same time, the mounting protrusions (14) in the mounting recess (11) of the casing (10) will engage the holding grooves (222) of the engaging protrusion (22) to hold the plug (20) securely with the casing (10).

Figure 5:
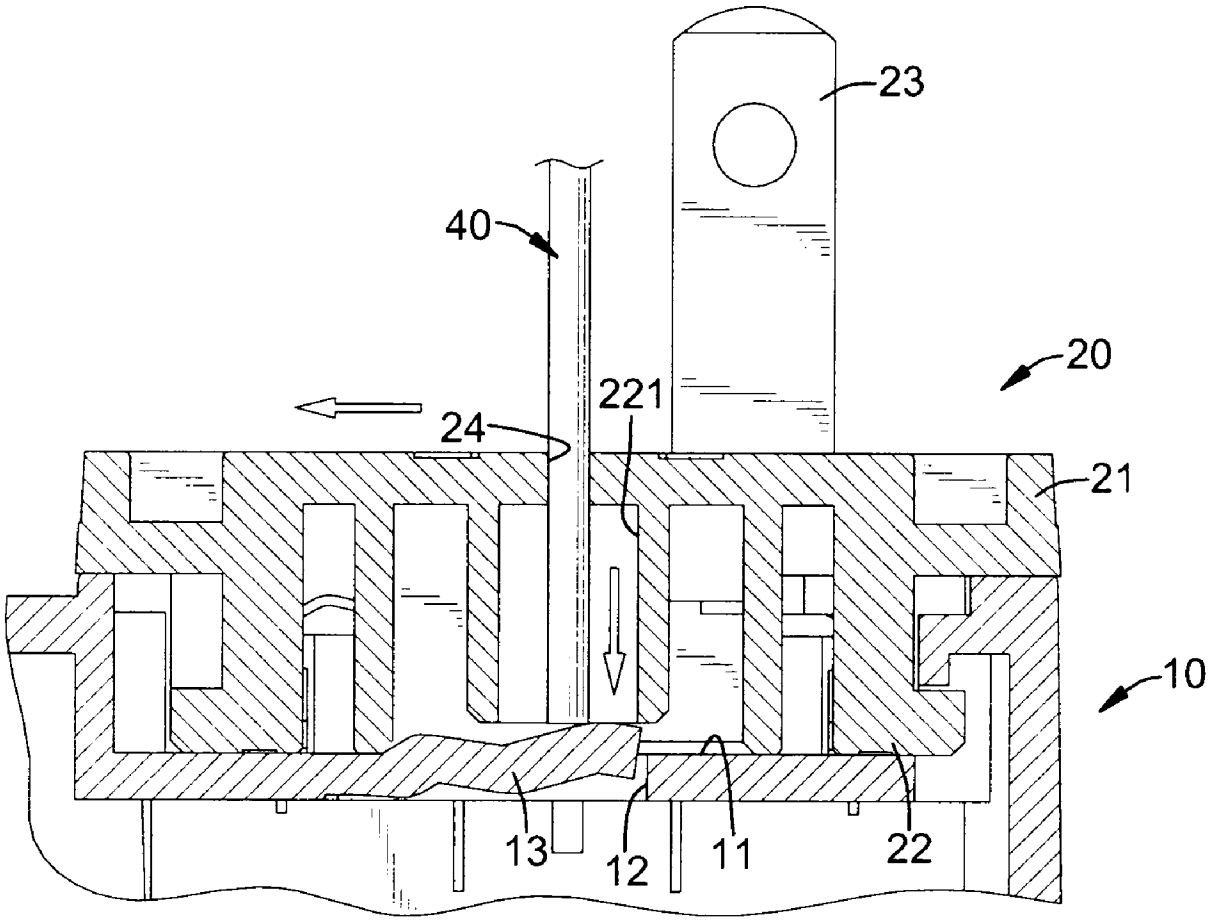
FIG. 5 is an operational side view in partial cross section of the converter in FIG. 2 showing that the plug being separated from the casing of the converter using an insertion pin.
Figure 6:
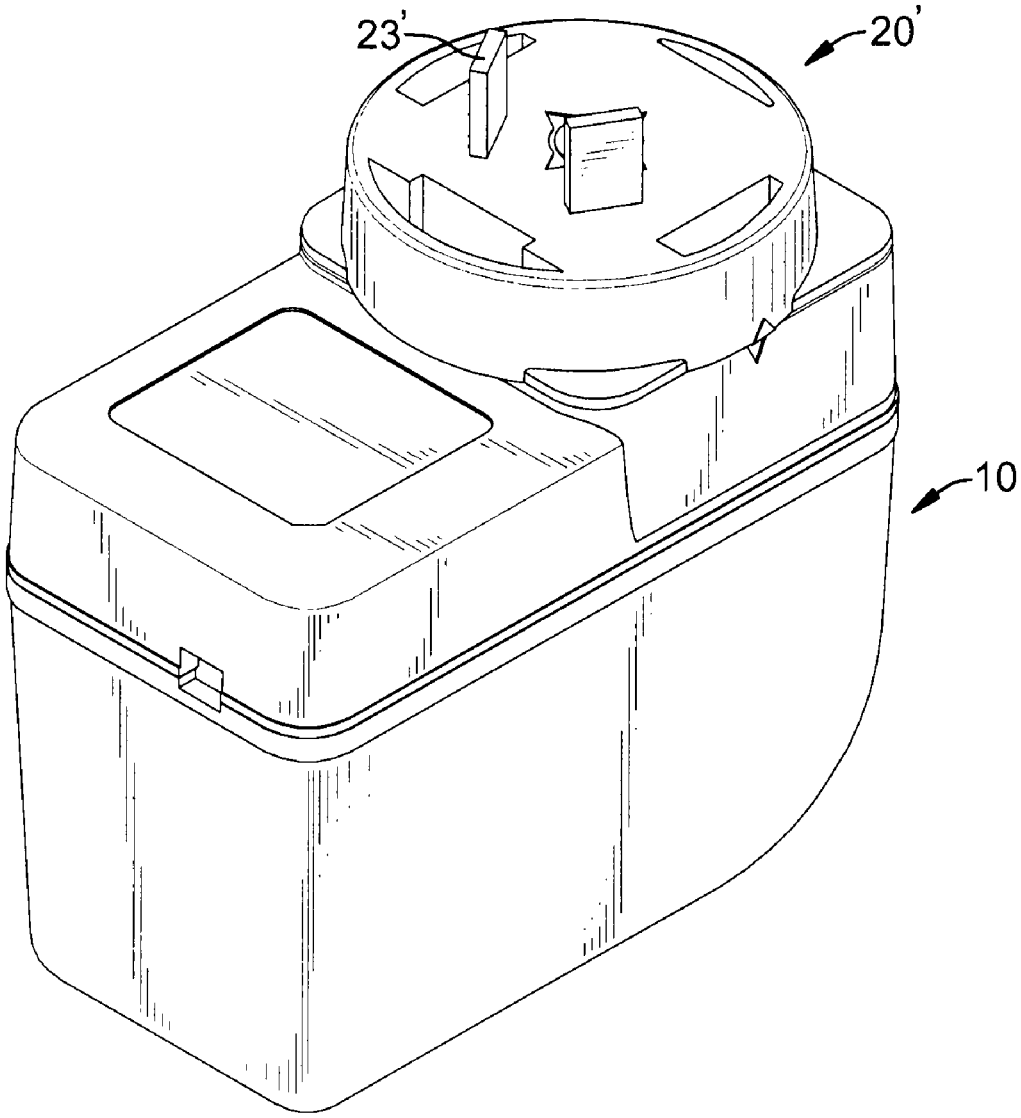
FIG. 6 is a perspective view of a second embodiment of a converter in accordance with the present invention.
Figure 7:
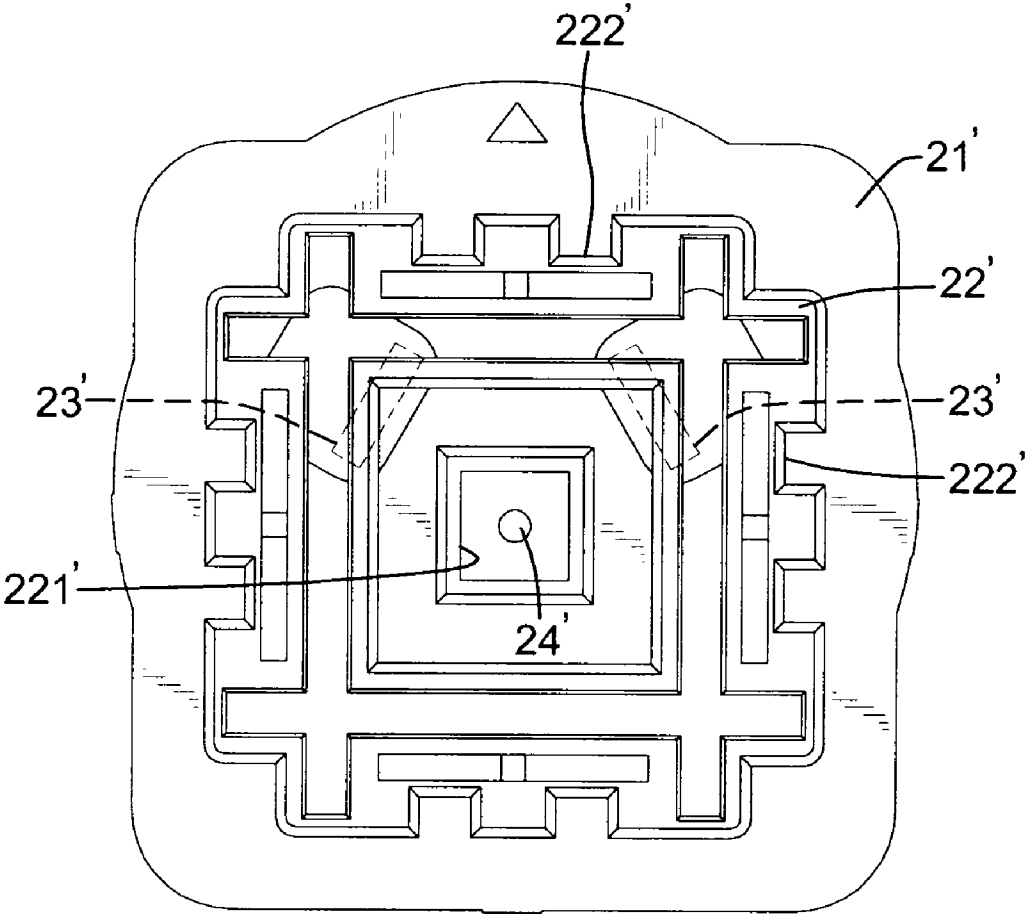
FIG. 7 is an enlarged side view in partial cross section of a connection side of a plug in FIG. 6.

With further reference to FIG. 5, when separating the plug (20) from the casing (10) for exchange, a pin (40) is inserted into the mounting recess (11) of the casing (10) via the pinhole (24) and the engaging hole (221) of the plug (20) to press the engaging tab (13) to move relative to the through hole (12)

and separate from the engaging hole (221) of the engaging protrusion (22). Then, moving the engaging protrusion (22) of the plug (20) relative to the mounting recess (11) of the casing (10) disengages the holding grooves (222) of the engaging protrusion (22) from the mounting protrusions (14) of the casing (10). Then, the plug (20) can be removed and replaced easily and conveniently.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A converter having a casing having a connection side;

a mounting recess being formed in the connection side of the casing and having a bottom, an annular sidewall and a center;

an engaging tab being formed on and protruding from the bottom of the mounting recess near the center of the mounting recess; and multiple mounting protrusions being formed on the annular sidewall of the mounting recess; and a plug being detachably mounted on the casing and having an escutcheon covering the mounting recess of the casing and having a bottom side; and a connection side;

an engaging protrusion being formed on and protruding from the connection side of the escutcheon, being mounted in the mounting recess of the casing and having a center;

an outer sidewall;

an engaging hole being formed in the center of the engaging protrusion to engage the engaging tab of the casing; and multiple holding grooves being formed on the outer sidewall of the engaging protrusion and engaging the mounting protrusions of the casing;

multiple terminals being formed on and protruding from the outer side of the escutcheon; and a pinhole being formed through the escutcheon and aligning with the engaging tab.

2. The converter as claimed in claim 1, wherein the casing has a through hole formed through the bottom of the mounting recess; and the engaging tab is disposed in the through hole.

3. The converter as claimed in claim 2, wherein the mounting recess is square and the engaging protrusion corresponds to the mounting recess.

4. The converter as claimed in claim 3, wherein the casing is a parallelepiped.

5. The converter as claimed in claim 4, wherein the through hole is square.

6. The converter as claimed in claim 1, wherein the mounting recess is square and the engaging protrusion corresponds to the mounting recess.

7. The converter as claimed in claim 1, wherein the casing is a parallelepiped.

* * * * *